US006086819A

United States Patent [19]

Commandeur et al.

[11] Patent Number: 6,086,819

[45] Date of Patent: Jul. 11, 2000

[54] PROCESS FOR MANUFACTURING THIN-WALLED PIPES

[75] Inventors: Bernhard Commandeur, Wulfrath; Rolf Schattevoy, Wuppertal; Klaus Hummert, Coesfeld; Dirk Ringhand, Ulm, all of Germany

[73] Assignee: Erbsloh Aktiengesellschaft, Velbert, Germany

[21] Appl. No.: 09/029,679

[22] PCT Filed: Aug. 28, 1996

[86] PCT No.: PCT/EP96/03778

§ 371 Date: Feb. 27, 1998

§ 102(e) Date: Feb. 27, 1998

[87] PCT Pub. No.: WO97/09457

PCT Pub. Date: Mar. 13, 1997

[30] Foreign Application Priority Data

Sep. 1, 1995 [DE] Germany ..... 195 32 253

[51] Int. Cl.[7] ..... B22F 7/00

[52] U.S. Cl. ..... 419/5; 419/41; 419/48

[58] Field of Search ..... 419/5, 6, 41, 48; 75/249

[56] References Cited

U.S. PATENT DOCUMENTS

| | | | |
|---|---|---|---|
| 3,325,279 | 6/1967 | Lawrence et al. . | |
| 4,135,922 | 1/1979 | Cebulak | 75/143 |
| 4,155,756 | 5/1979 | Perrot et al. | 75/231 |

FOREIGN PATENT DOCUMENTS

| | | |
|---|---|---|
| 0366134 | 10/1989 | European Pat. Off. . |
| 0341714 | 11/1989 | European Pat. Off. . |
| 0100470 | 5/1990 | European Pat. Off. . |
| 0411577 | 2/1991 | European Pat. Off. . |
| 0466120 | 1/1992 | European Pat. Off. . |
| 0529520 | 3/1993 | European Pat. Off. . |
| 0577436 | 1/1994 | European Pat. Off. . |
| 0589137 | 3/1994 | European Pat. Off. . |
| 0592665 | 4/1994 | European Pat. Off. . |
| 0363225 | 6/1994 | European Pat. Off. . |
| 0746633 | 12/1994 | European Pat. Off. . |
| 0669404 | 8/1995 | European Pat. Off. . |
| 0710729 | 5/1996 | European Pat. Off. . |
| 0526079 | 11/1996 | European Pat. Off. . |
| 0777043 | 11/1996 | European Pat. Off. . |
| 0529993 | 1/1997 | European Pat. Off. . |
| 0600474 | 1/1997 | European Pat. Off. . |
| 0788413 | 2/1997 | European Pat. Off. . |
| 62-11395 | 7/1988 | Japan . |
| 62-11396 | 7/1988 | Japan . |
| 6330263 | 11/1994 | Japan . |

OTHER PUBLICATIONS

Chemical Abstracts, vol. 98, No. 20, May 16, 1983, Columbus, Ohio, Abstract No. 165644, Japan: "Abrasion–Resistant Alluminum . . . ".

*Primary Examiner*—Ngoclan Mai
*Attorney, Agent, or Firm*—Horst M. Kasper

[57] ABSTRACT

A process is disclosed for manufacturing thin-walled pipes made of a heat- and wear-resistant aluminium-based material. A billet or tube blank made of a hypereutectic AlSi material is produced, optionally overaged by an annealing process, then extruded into a thick-walled pipe or round bar. The thus obtained preform is severed and extruded into a thin-walled pipe. This process is particularly suitable to manufacture light metal cylinder liners for internal combustion engines, since the thus manufactured cylinder liners have the required properties regarding wear-resistance, heat-resistance and lowered pollutant emissions.

22 Claims, 2 Drawing Sheets

PROCESS FOR MANUFACTURING THIN-WALLED PIPES

Figures 1A, 1B, 1C, 1D:
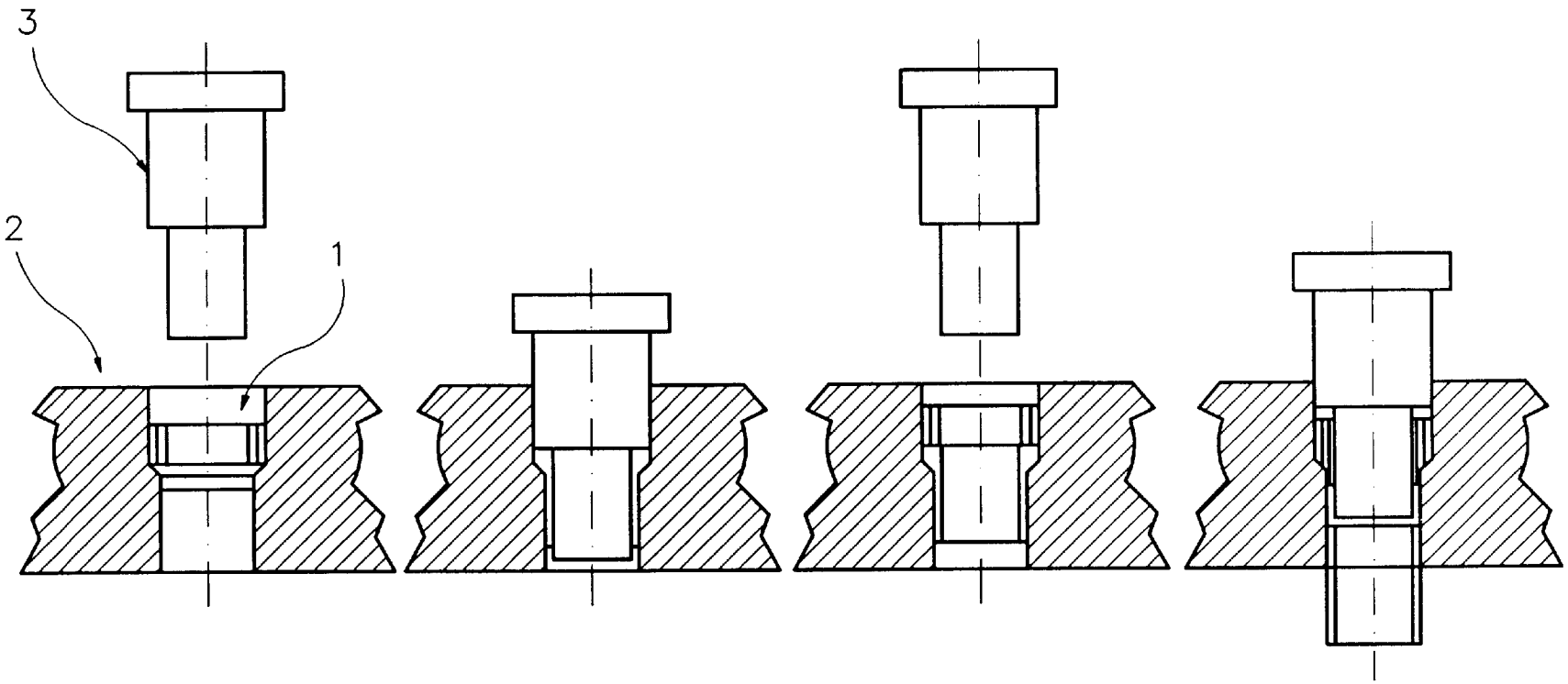

The invention relates to a method for manufacturing thin-walled pipes, which pipes are made of a heat-resistant and wear-resistant aluminum-based material, in particular for use as cylinder liners for internal combustion engines.

Cylinder liners are components subject to wear, which are inserted, pressed or cast into the cylinder openings of the crankcase of the internal combustion engine.

The cylinder faces of an internal combustion engine are subjected to high frictional loads from the pistons or, respectively, from the piston rings and to locally occurring high temperatures. It is therefore necessary that these faces be made of wear-resistant and heat-resistant materials.

In order to achieve this goal, there are numerous processes amongst others to provide the face of the cylinder bore with wear-resistant coatings. Another possibility is to dispose a cylinder liner made of a wear-resistant material in the cylinder. Thus, gray-cast-iron cylinder liners were used, amongst others, which liners however exhibit a low heat conductivity as compared to aluminum-based materials and exhibit other disadvantages.

The problem was first solved with a cast cylinder block made of a hypereutectic aluminum-silicon AlSi alloy. The silicon content is limited to a maximum of 20 weight-percent for reasons associated with casting technology. As a further disadvantage of the casting method it is to be mentioned that primary silicon particles of relatively large dimensions (about 30–80 $\mu$m) are precipitated during the solidification of the melt. Based on the size and their angular and sharp-edged form, the primary silicon Si particles lead to wear at the piston and piston rings. One is therefore forced to protect the pistons and the piston rings with corresponding protective layers/coatings. The contact face of the silicon Si particles to the piston/piston ring is flat-smoothed through mechanical machining treatment. An electrochemical treatment then follows to such a mechanical treatment, whereby the aluminum matrix is slightly reset between the silicon Si grains such that the silicon Si grains protrude insignificantly as support structure from the cylinder face. The disadvantage of thus manufactured cylinder barrels lies, on the one hand, in a substantial manufacturing expenditure (costly alloy, expensive mechanical machining treatment, iron-coated pistons, armored and reinforced piston rings) and, on the other hand, in the defective distribution of the primary silicon Si particles. Thus, there are large areas in the microstructure which are free of silicon Si particles and thus are subject to an increased wear. In order to prevent this wear, a relatively thick oil film is required as separation medium between barrel and friction partner. The clearing depth of the silicon Si particles is amongst others decisive for the setting of the oil-film thickness. A relatively thick oil film leads to higher friction losses in the machine and to a larger increase of the pollutant emission.

In comparison, a cylinder block according to the DE 42 30 228, which is cast of an below-eutectic aluminum-silicon AlSi alloy and is provided with liners of a hypereutectic aluminum-silicon AlSi alloy material is more cost advantageous. However, the aforementioned problems are also not solved in this case.

In order to employ the advantages of the hypereutectic aluminum-silicon AlSi alloys as a liner material, the microstructure in regard to the silicon grains is to be changed. As is known, aluminum alloys, which cannot be realized using casting technology, can be custom-produced by powder-metallurgic processes or spray compacting.

Thus, in this way hypereutectic aluminum silicon AlSi alloys are produceable which have a very good wear resistance and receive the required heat resistance through alloying elements such, as for example iron Fe, nickel Ni, or manganese Mn, based on the high silicon content, the fineness of the silicon particles, and the homogeneous distribution. The primary silicon particles present in these alloys have a size of about 0.5 to 20 $\mu$m. Therefore, the alloys produced in this way are suited for a liner material.

Even though aluminum alloys are in general easy to be processed, the deformation of these hypereutectic alloys is more problematic. A method for producing liners from a hypereutectic aluminum-silicon alloy is known from the German printed patent document EP 0 635 318. According to this reference the liner is produced by extrusion presses at pressures of from 1000 to 10000 t and an extrusion speed of 0.5 to 12 m/min. Very high extrusion rates are required in order to produce cost-effectively the liners to a final dimension with extruders. It has been shown that the high extrusion rates lead to a tearing of the profile during extrusion in case of such difficultly extrudable alloys and of the small wall thicknesses of the liners to be achieved.

The object of the invention is to provide for an improved, cost-advantageous method for manufacturing liners, wherein the finished liners are to exhibit the required property improvements in regard to wear resistance, heat resistance, and reduction of the pollutant emission.

According to the invention, the object is solved by a method with the method steps recited in patent claim 1.

Additional embodiments of the invention are given in the sub-claims.

The required tribological properties are in particular achieved in that methods are employed which allow a far higher solidification rate of a high-alloy melt.

On the one hand, the spray compacting method (in the following referred to as "spray compacting") belongs to this. An aluminum alloy melt, highly alloyed with silicon, is atomized and cooled in the nitrogen stream at a cooling rate of 1000° C./s. The in part still liquid powder particles are sprayed onto a rotating disk. The disk is continuously moved downwardly during the process. A cylindrical billet is generated by the superposition of the two motions, wherein the billet has dimensions of from approximately 1000 to 3000 in length at a diameter of up to 400 mm. Primary silicon Si precipitates up to a size of 20 $\mu$m are generated in this spray compacting process based on the high cooling rate. In this case, the silicon Si content of the alloys can amount to 40 weight-%. The supersaturation state in the resulting billet is quasi "frozen" based on the fast quenching of the aluminum melt in the gas stream.

Alternatively to the billet manufacture, also thick-walled tube blanks having inner diameters of from 50–120 mm and a wall thickness up to 250 mm can be manufactured with the spray compacting. For this purpose, the particle stream is directed after the atomization onto a support pipe, rotating horizontally around its longitudinal axis, and is compacted there. Based on a continuous and controlled advance in horizontal direction, a tube blank is produced in this way, which tube blank serves as stock blank for the further processing by tube extrusion presses and/or other hot-deformation processes. The aforementioned support pipe is made of a conventional aluminum wrought alloy or of the same alloy, as it is manufactured by the spray compacting (of the same kind).

The microstructural condition of the spray-compacted billet or the spray-compacted tube blank can be changed with subsequent averaging annealing processes. The microstructure can be set with an annealing to a silicon grain size of from 2 to 30 μm as it is desired for the required tribological properties. The growing of larger silicon Si particles during the annealing process is effected by diffusion in the solid at the expense of smaller silicon particles. This diffusion is dependent on the overaging and annealing temperature and the duration of the annealing treatment. The higher the temperature is chosen, the faster the silicon Si grains grow. In this process, however, the time has a lesser role. Suitable temperatures are at about 500° C., wherein an annealing duration of 3 to 5 hours is sufficient.

If a condition with a fine silicon Si precipitate size is desired, an annealing process is not necessary. An adaptation of the silicon Si precipitate size is achieved in this case based on the "gas to metal ratio" during the process. Billets and tube blanks, manufactured with the spray compacting method, exhibit as a rule a density of more than 95% of the theoretical density of the alloy. Hot extrusion at temperatures of from 350° to 550° C. is required for the complete densification and closure of the residual porosity.

The spray compacting process in addition offers the possibility to enter particles with a particle injector into the billets or into the tube blanks, which particles were not present in the melt. There exists a plurality of adjustment possibilities for a microstructure since these particles can exhibit any desired geometry and any desired size between 2 μm and 400 μm. These particles can be, for example, silicon Si particles in the range of from 2 μm to 400 μm or oxide-ceramic particles (for example, $Al_2O_3$) or non-oxide-ceramic particles (for example, SiC, $B_4C$, etc.) in the aforementioned particle-size spectrum, as they are commercially available and sensible for the tribological aspect.

A further possibility to produce a suitable microstructure formation lies in the fast solidification of an aluminum alloy melt, supersaturated with silicon (in the following "powder route"). For this purpose, a powder is produced by means of an air atomization or inert-gas atomization of the melt. This powder can on the one hand be completely alloyed, which means that all alloy elements were contained in the melt, or the powder is mixed from several alloy powders or element powders in a subsequent step. The completely alloyed powder or the mixed powder is subsequently pressed by cold-isostatic pressing or hot pressing or vacuum hot-pressing to a billet or a tube blank. The billets or the tube blanks can then be completely compacted with hot extruders. Tribologically meaningful microstructures can ensue, on the one hand, by an annealing treatment and, on the other hand, by admixture of particles (oxide-ceramics, non-oxide ceramics, etc.) also with this production method.

The thereby resulting and therefore custom-made microstructure no longer changes in the subsequent processing steps or it changes favorably for the required tribological properties.

A thick-walled pipe with a wall thickness of from 6 to 20 mm or a round bar having a diameter between 50 mm and 120 mm is formed by extrusion from the billet blank, which was manufactured by "spray compacting" or by the "powder route". For this purpose, the extrusion temperatures are between 300° C. and 550° C. The extrusion of a round bar offers advantages in regard to the achievable press extrusion rates, which renders the manufacture of round bars more cost effective.

Thick-walled pipes with reduced wall thicknesses can also be obtained from the tube blanks, wherein the tube blanks were manufactured by "spray compacting" or by the "powder route".

The required deformation is achieved by extrusion molding. For this purpose, there are employed either pipe sections or bar sections having a somewhat larger volume than the thin-walled pipe to be produced. When pipe sections are employed, both hollow—forward—extrusion molding as well as hollow—backward—extrusion molding with or without counterpressure can be employed. When bar sections are employed, both cup can—forward—extrusion molding as well as cup can—backward—extrusion molding with or without counterpressure can be employed.

The counterpressure can be applied in all process by a stamp. The counterpressure allows the furnishing of a stress state in the material to be deformed, which prevents the formation of cracks in the deformed material. This is in particular necessary in case of materials which have only a limited deformation capability at room temperature.

The temperature range, within which the deformation can take place without causing changes in the custom-made microstructure, ranges from room temperature up to temperatures of 480° C. A deformation in temperature ranges (dependent on the alloy system between 520° C. and 600° C., during which there occurs a liquid phase, is also possible. In this case, a coarsening of the silicon precipitates from 10 μm to 30 μm is achieved, such as it is also tribologically still meaningful, if one does not start from a non-annealed blank.

The pipe, formed to the final wall thickness or close to the final wall thickness, is subsequently finished by machining the ends of the pipes. In case of the cup can - forward and the cup can—backward—extrude, the thin-walled bottom floor is removed by machining or stamping.

The invention method has the advantage that the material for the liner can be custom-made. The high expenditure in the case of extruding, both in regard to extrusion pressure, extrusion rate, as well as product quality, is avoided based on the subsequent second hot-deformation process step.

EXAMPLE 1

An alloy of the composition $Al_1$ $Si_{25}$ $Cu_{2.5}$ $Mg_1$ $Ni_1$ is compacted to a billet according to the spray compacting process at a melt temperature of 830° C. with a gas/metal ratio of 4.5 $m^3$/kg (standard cubic meter gas per kilogram of melt). The silicon Si precipitates in the size range of from 1 μm to 10 μm are present under the recited conditions in the spray-compacted billet. The spray-compacted billet is subjected to an annealing treatment of four hours at 520° C. The silicon Si precipitates are in the size range of from 2 μm to 30 μm after this annealing treatment. A pipe with an outer diameter of 94 mm and an inner diameter of 68 mm is produced in a porthole die by hot extruding at 420° C. and a profile exit speed of 0.5 m/min. Since the extrusion temperature is below the annealing temperature, the ensuing microstructure is maintained.

The extruded, thick-walled pipes are cut to short sections of a length of 30 mm and are formed at 420° C. by Hollow—Forward—Extrude to thin-walled pipe sections having an outer diameter of 74 mm, an inner diameter of 67 mm, and a length of 130 mm. For this purpose, the pipes can be completely formed without flanges, collars or shoulders since each section is being extruded with the next following section.

As can be seen on the FIG. 1A, the blank (1) is placed into the matrix mold (2). The press pin (3) (hollow method) in cooperation with the matrix mold (2) forms the first blank (1) in part to a pipe (FIG. 1, Section B). The press pin (3) then moves again into the starting position and the following blank is placed into the matrix mold (2) (FIG. 1, Section C). Upon the subsequent pressing down of the press pin (3), the first pipe section is completely formed and ejected (FIG. 1, Section D) with the aid of the second blank.

Based on this procedure, a counterpressure is generated at the same time in the form-giving press channel which facilitates a defect-free deformation.

EXAMPLE 2

An alloy, as it was produced in the Example 1 by spray-compacting, is extruded to a round bar having an outer diameter of 74 mm. Based on the simpler geometry, a press extrusion rate of 1.5 m/min is achieved which translates into not insignificant cost savings. The bar is divided into sections having a length of 27 mm. These sections are then formed by Cup Can—Backward—Extrude at temperatures of 420° C. to a cup can having an outer diameter of 74 mm, an inner diameter of 67 mm and a height of 130 mm. The thin floor having a thickness of 4 mm is subsequently cut out during the machining of the pipe ends.

EXAMPLE 3

An alloy, as it was produced in Example 1 and 2 by spray-compacting, is extruded without prior annealing to a round bar having an outer diameter of 74 mm. The primary silicon Si precipitate are in the size range of from 1 μm to 7 μm. The bar is divided into sections having a length of 27 mm. These sections are inductively heated within 4 to 5 minutes to a temperature of 560° C. At this temperature the alloy is between solidus and liquidus. The partly liquid bar section is mechanically stable and can be handled and manipulated.

Figures 2E, 2F, 2G:
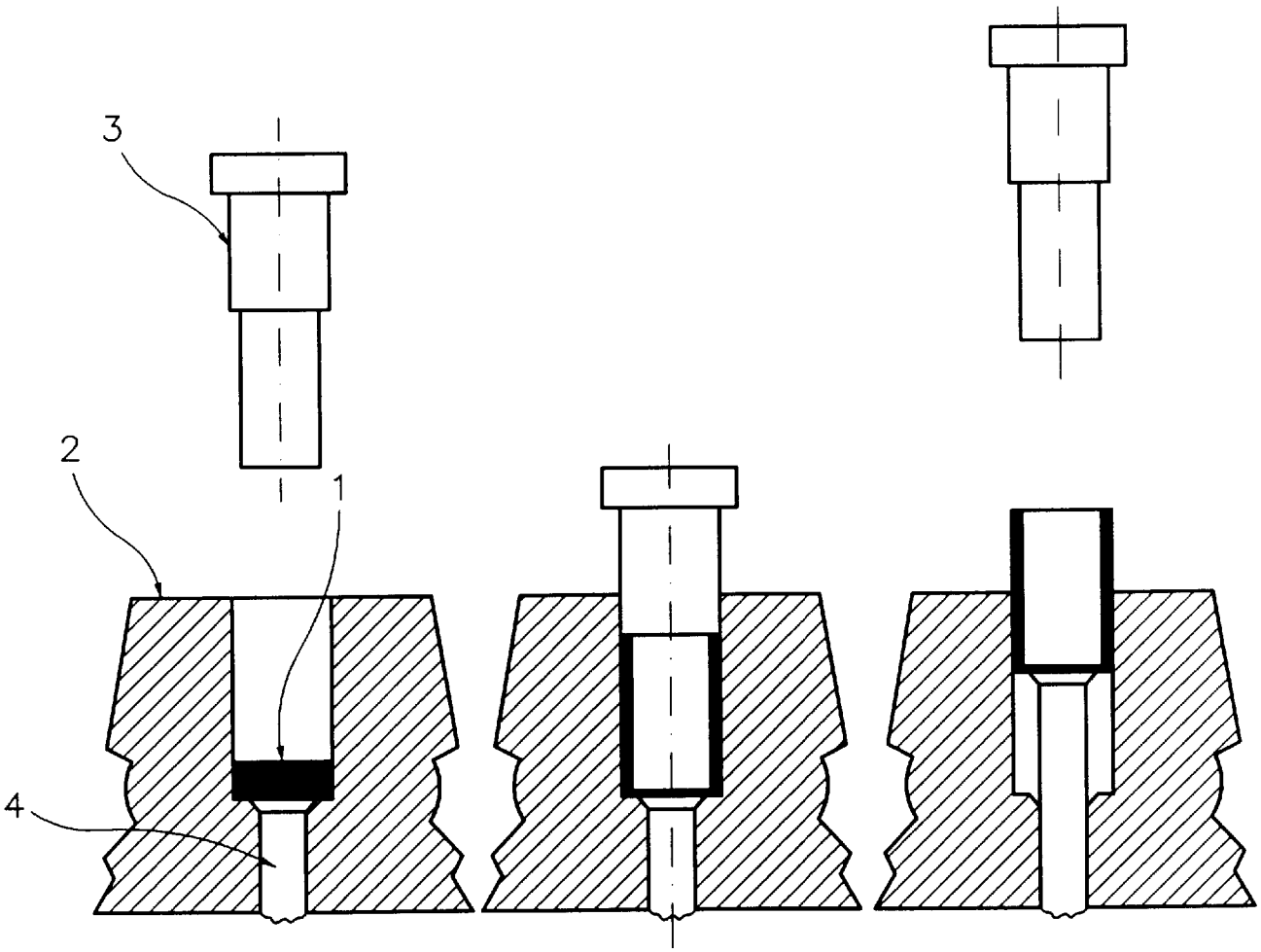

As can be seen in FIG. 2, the partly liquid bar section (1) is formed by Cup Can—Backward—Extrude in a closed tool, which tool comprises an extrusion punch (3) (cup can method), a matrix mold (2), and an ejector (4). For this purpose, the section (1) is placed into the tool (FIG. 2, Section E), is formed with the extrusion punch (3) (FIG. 2, Section F) and is ejected by the motion of the ejector (4) (FIG. 2, G). There results a cup can having an outer diameter of 74 mm, an inner diameter of 67 mm, and a height of 130 mm. The floor of the formed, disentangled and lifted cup can of a thickness of 4 mm can subsequently be cut out during the machining of the pipe ends or can be removed by stamping.

Only very small deformation forces are required based on the partly liquid state. The silicon Si precipitates grow to 30 μm to 25 μm as a function of this partly liquid state.

We claim:

1. A method for manufacturing liners for internal combustion engines made of a hypereutectic AlSi alloy comprising the steps of melting a hypereutectic AlSi alloy to obtain an alloy melt;

spray compacting the alloy melt to obtain starting structures, wherein contained primary silicon Si particles have a size of from about 0.5 to 20 μm;

maintaining the starting structures at an extrusion temperature of from about 300 to 550° C.;

extruding the starting structures to round preforms having an outer diameter of less than 120 mm;

cutting the round preforms into sections of a desired length; and forming said sections of the preforms by extrusion molding at temperatures of from about 25 to 600° C. to tubular blanks having a wall thickness of from about 1.5 to 5 mm.

2. The method according to claim 1, wherein the starting structures are billets.

3. The method according to claim 1, wherein the starting structures are tube blanks.

4. The method according to claim 1, wherein the contained primary silicon Si particles have a size of from 1 to 10 μm.

5. The method according to claim 1, further comprising annealing said starting structures in case of need for coarsening the contained primary silicon Si particles to overage them for growing the primary silicon Si particles to a size of from about 2 to 30 μm.

6. The method according to claim 1, wherein the alloy melt employed for manufacturing the starting structures has about the following composition:

AlSi(17–35)Cu(2.5–3.5)Mg(0.2–2.0)Ni(0.5–2).

7. The method according to claim 1, wherein the alloy melt employed for manufacturing the starting structures has about the following composition:

AlSi(17–35)Fe(3–5)Ni(1–2).

8. Method according to claim 1, wherein the alloy melt employed for manufacturing the starting structures has about the following composition:

AlSi(25–35).

9. The method according to claim 1, wherein the alloy melt employed for manufacturing the starting structures has about the following composition:

AlSi(17–35)Cu(2.5–3.3)Mg(0.2–2.0)Mn(0.5–5).

10. The method according to claim 1, further comprising melting an Al alloy with from about 5 to 15 weight percent of silicon to obtain an alloy melt:

spray compacting the alloy melt;

furnishing a part of the silicon Si in the step of spray compacting from a melt of an aluminum-silicon AlSi alloy employed for that purpose into the starting structure; and furnishing a part of the silicon in the form of silicon Si powder by means of a particle injector into the starting structure during spray compacting to obtain a starting structure made of a hypereutectic AlSi alloy.

11. The method according to claim 1, further comprising annealing said starting structures at temperatures of from about 460 to 540° C. over a time period of from about 0.5 to 10 hours in case of need for coarsening the contained primary silicon Si particles to overage them for growing the primary silicon Si particles to a size of from about 2 to 30 μm.

12. The method according to claim 1, wherein the starting structures are billets and further comprising maintaining the billets at an extrusion temperature;

extruding the billets to a round bar having a diameter of from about 50 to 120 mm;

subsequently cutting said round bar into bar sections; forming the bar sections to cup cans by Cup Can—Forward Extrude and Cup Can—Backward—Extrude, respectively, at temperatures of from about 25 to 600° C., wherein the cup cans have a wall thickness of from about 1.5 to 5 mm and a thin-walled floor; and removing the floor for forming desired pipes.

13. The method according to claim 1, further comprising keeping the starting structures at an extrusion temperature;

extruding the starting structures to thick-walled pipes having a wall thickness of from about 6 to 20 mm;

subsequently cutting the thick-walled pipes into pipe sections;

forming thick-walled, short pipe sections to longer pipe sections having a reduced wall thickness of from about 1.5 to 5 mm by Hollow—Forward—Extrude and Hollow—Backward —Extrude, respectively, at temperatures of from about 25 to 600° C.

14. The method according to claim 1, further comprising performing a deformation by extrusion molding at temperatures of from about 25 to 480° C.

15. The method according to claim 1, further comprising performing a deformation by extruding at temperatures above a solidus temperature and below a liquidus temperature of a hypereutectic aluminum-silicon AlSi material.

16. A method for manufacturing liners for internal combustion engines made of a hypereutectic AlSi alloy comprising the steps of generating a metallic powder in a particle size of less than about 250 μm by atomization of a hypereutectic AlSi alloy melt, wherein contained primary silicon Si particles have a size of from about 0.5 to 20 μm;

compacting the metallic powder to obtain starting structures;

maintaining the starting structures at an extrusion temperature of from about 300 to 550° C.;

extruding the starting structures to round preforms having an outer diameter of less than 120 mm;

cutting the round preforms into sections of a desired length; and forming said sections of the preforms by extrusion molding at temperatures of from about 25 to 600° C. to tubular blanks having a wall thickness of from about 1.5 to 5 mm.

17. The method according to claim 16, further comprising compacting the metallic powder by hot compacting.

18. The method according to claim 16, further comprising compacting the metallic powder by cold compacting.

19. The method according to claim 16, wherein the metallic powder is a member selected from the group consisting of metal powder, alloy powder, and mixtures thereof obtained by atomization in a presence of a member selected from the group consisting of inert gas, air, and mixtures thereof.

20. Method for manufacturing liners for internal combustion engines made of a hypereutectic AlSi alloy comprising the steps of:

wherein generating billets or tube blanks by spray compacting an alloy melt or by hot compacting and cold compacting, respectively, a mixture of metal powder or alloy powder, obtained by air atomization or inert-gas atomization in a particle size of smaller than about 250 μm, wherein the contained primary silicon Si particles have a size of from about 0.5 to 20 μm, subjecting said billets or tube blanks, in case of need for coarsening the contained primary silicon Si particles, to an averaging annealing, wherein the primary silicon Si particles grow to a size of from about 2 to 30 μm, maintaining the billets or tube blanks at an extrusion temperature of from about 300 to 550° C., extruding the billets or tube blanks to round preforms having an outer diameter smaller than about 120 mm, cutting the round preforms into sections of a desired length, and forming these sections of the preforms by extrusion at temperatures of from about 25 to 600° C. to tubular blanks having a wall thickness of about 1.5 to 5 mm.

21. A method for manufacturing liners for internal combustion engines made of a hypereutectic AlSi alloy comprising the steps of generating a metallic powder consisting of a mixture of alloy powder in a particle size of less than about 250 μm obtained by atomization of an aluminium alloy melt and silicon Si metal powder and in case of need of an additional metal powder, all metal powder in a particle size of less than about 50 μm, and wherein contained primary silicon Si particles have a size of from about 0.5 to 20 μm, compacting the metallic powder to obtain starting structures;

maintaining the starting structures at an extrusion temperature of from about 300 to 550° C.;

extruding the starting structures to round preforms having an outer diameter of less than 120 mm;

cutting the round preforms into sections of a desired length; and forming said sections of the preforms by extrusion molding at temperatures of from about 25 to 600° C. to tubular blanks having a wall thickness of from about 1.5 to 5 mm.

22. The method for manufacturing liners according to claim 21 wherein all metal powder is present in a particle size of less than about 10 μm.

* * * * *